United States Patent [19]

Niedert

[11] 4,430,856

[45] Feb. 14, 1984

[54] PORT LINER AND METHOD OF ASSEMBLY

[75] Inventor: David W. Niedert, Cedar Falls, Iowa

[73] Assignee: Deere & Company, Moline, Ill.

[21] Appl. No.: 321,141

[22] Filed: Nov. 13, 1981

[51] Int. Cl.[3] ..... F01N 3/10

[52] U.S. Cl. ..... 60/272; 60/282; 29/156.4 R; 123/193 H

[58] Field of Search ..... 60/272, 282; 123/193 H; 29/156.4 R, 156.4 W L, 455

[56] References Cited

U.S. PATENT DOCUMENTS

| | | | |
|---|---|---|---|
| 2,260,656 | 10/1941 | Bell | 60/272 |
| 3,983,696 | 10/1976 | Pflugfelder | 60/282 |
| 4,031,699 | 6/1977 | Suga | 60/282 |
| 4,089,163 | 5/1978 | Yamazaki | 60/282 |
| 4,120,154 | 10/1978 | Yokota | 60/282 |
| 4,195,477 | 4/1980 | Yamazaki et al. | 60/282 |
| 4,195,478 | 4/1980 | Rao et al. | 60/282 |
| 4,258,547 | 3/1981 | Fenn | 60/272 |

FOREIGN PATENT DOCUMENTS

| | | | |
|---|---|---|---|
| 2323793 | 11/1974 | Fed. Rep. of Germany | 60/282 |

OTHER PUBLICATIONS

Society of Automotive Engineers, Inc., "An Analytical Study of Exhaust Gas Heat Loss in a Piston Engine Exhaust Port", by S. D. Hires and G. L. Pochmara, No. 760767, Oct. 18–22, 1976.

*Primary Examiner*—Douglas Hart

[57] ABSTRACT

An improved port liner and its method of assembly into a cylinder head of an engine such that an air insulating layer is formed between the outer periphery of the liner and the inner diameter of an exhaust passage. The liner is a thin, stainless steel member having an arcuately-shaped section and a straight section which permits it to be inserted only one way into an exhaust passage. This is important for it allows for automated machine assembly of a valve guide which must be pressed through an opening located in the outer surface of the liner. The method of assembly also limits the physical contact between the liner and the cylinder head and this in conjunction with the air layer reduces the loss of thermal energy from the passing exhaust gases.

8 Claims, 2 Drawing Figures

PORT LINER AND METHOD OF ASSEMBLY

FIELD OF THE INVENTION

This invention relates to an improved port liner for an internal combustion engine and to a method of assembling the liner in an exhaust passage formed in the cylinder head of the engine.

BACKGROUND OF THE INVENTION

For some time, port liners have been used in exhaust passages of internal combustion engines to minimize cooling of the exhaust gases as they pass from the combustion chamber to the emisson control equipment. It is common knowledge to those skilled in the engine arts that if the temperature of the exhaust gases can be maintained at a high level, then the efficiency of a turbocharger, a catalytic converter or a thermal reactor can be increased. Such an increase improves the fuel efficiency of the vehicle as well as minimizing the quantities of unburned hydrocarbons and carbon monoxide which will be discharged into the atmosphere. Various approaches to reduce the heat loss in the exhaust gases of an engine were presented in the Oct. 18-22, 1976 publication by the Society of Automotive Engineers, pages 1-15. The publication is entitled "An Analytical Study of Exhaust Gas Heat Loss in a Piston Engine Exhaust Port" and was prepared by S. D. Hires and G. L. Pochmara. This paper describes several types of liners including an air gap exhaust port (see page 3, FIG. 7) which can improve the effectiveness of an engine's emission control system by conserving the thermal energy in the exhaust gas. The air gap serves as an insulative barrier which reduces the thermal conductivity of the heat in the exhaust gas as it leaves the combustion chamber of the engine. However, the exhaust port liner depicted in FIG. 7 of the SAE publication is complicated in construction and does not lend itself to assembly line fabrication and assembly. Furthermore, the liner directly contacts the inner periphery of the exhaust passage at several locations thereby producing a segmented air insulating layer.

SUMMARY OF THE INVENTION

Briefly, this invention relates to an improved port liner and its method of assembly into an exhaust passage of an engine which produces a single continuous air insulating layer between the outer periphery of the liner and the inner surface of the exhaust passage. The liner is constructed as a thin wall tubular member having an arcuately-shaped section and a straight section. Formed on the outer curved surface of the arcuately-shaped section is an opening through which a valve guide and valve stem can pass. The liner is constructed so that it can be inserted only one way into the exhaust passage and is so arranged that a single air layer is formed about the liner having an almost uniform thickness. The straight section of the liner extends beyond the cylinder head and into an adjoining manifold to reduce thermal loss which could otherwise occur at the respective interfaces.

The general object of this invention is to provide an improved port liner which cooperates with the inside surface of a flow passage to form an air insulating layer which reduces the heat lost of a flowing gas. A more specific object of this invention is to provide an improved exhaust port liner and a method of assembling it in the exhaust passage of an engine such that the assembly method can be done by machines rather than manually.

Another object of this invention is to provide a method of assembling the exhaust port liner into an exhaust passage which is fail-safe so as to prevent tool failure when a valve guide is pressed through an opening therein.

Still another object of this invention is to provide an exhaust port liner which cooperates with the inner surface of an exhaust passage to form a single, continuous air insulative layer therebetween which will assist in improving the effectiveness of the emission control system of an engine.

A further object of this invention is to provide an improved exhaust port liner which will optimize expansion and flow of exhaust gases as they leave the combustion chamber of an engine and travel out to the exhaust manifold.

Other objects and advantages of the present invention will become more apparent to those skilled in the art in view of the following description and the drawings.

DETAILED DESCRIPTION OF THE PREFERRED EMBODIMENT

Figure 1:
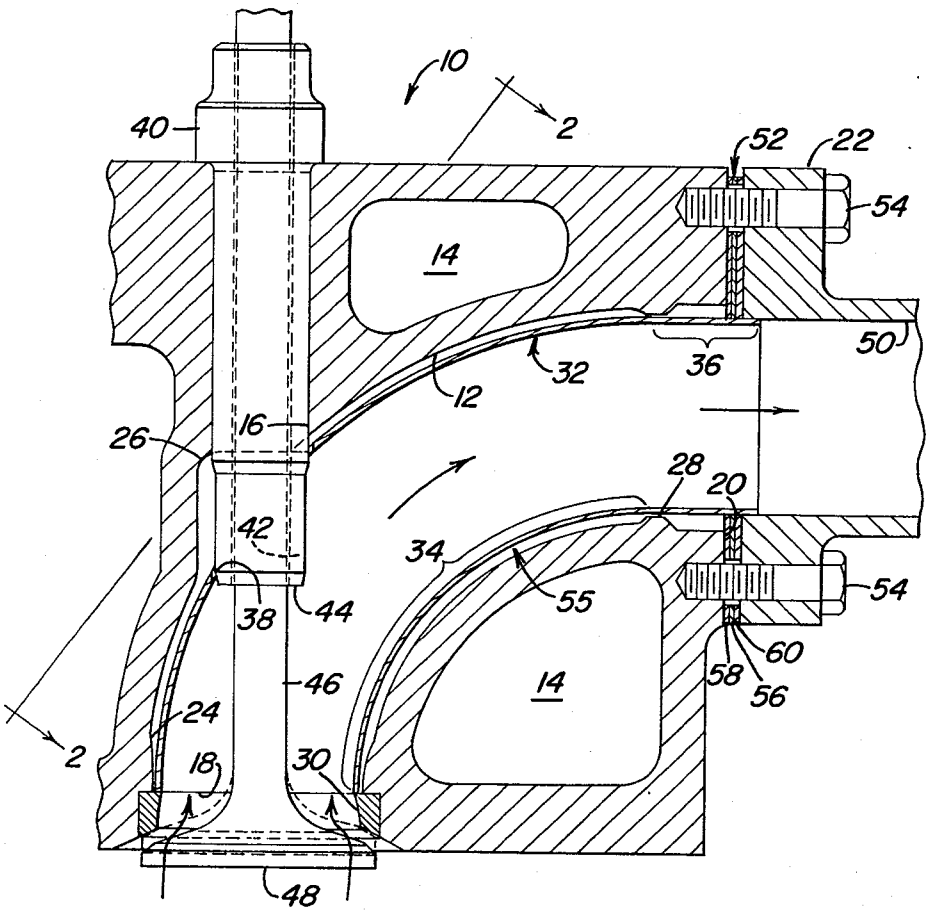
FIG. 1 is a cross-sectional assembly view of a portion of a cylinder head having an exhaust passage and an improved exhaust port liner positioned therein.

Referring to FIG. 1, a portion of a cylinder head 10 of an internal combustion engine is shown. Formed within the cylinder head 10 is an exhaust passage 12, a cooling passage 14 and a narrow, cylindrical passageway 16 which intersects the exhaust passage 12. The exhaust passage 12 is of a curved configuration having first and second open ends 18 and 20, respectively which communicate with a combustion chamber of the engine (not shown) and an adjoining exhaust manifold 22. The inner diameter of the exhaust passage 12 is relatively uniform except for: a tapering neck 24 immediately adjoining the first end 18, a step 26 adjacent the inner end of the passageway 16, and a shoulder 28 approximate the second end 20 which extends about the inner peripheral surface a complete 360 degrees. The purpose of the tapering neck 24 and the shoulder 28 will be explained shortly.

Positioned at the first end 18 of exhaust passage 12 is a valve seat 30 which is press fitted into the cylinder head 10. This valve seat 30 provides a stop for an improved exhaust port liner 32 which is positioned within the exhaust passage 12. The liner 32 is a thin, tubular stainless steel member having a wall thickness of about 1 millimeter. The liner 32 is configurated to have an arcuately-shaped section 34 and a straight section 36. The arcuately-shaped section 34 is curved to conform to the curvature of the exhaust passage 12 and preferably has a curvature of approximately 90 degrees.

Figure 2:
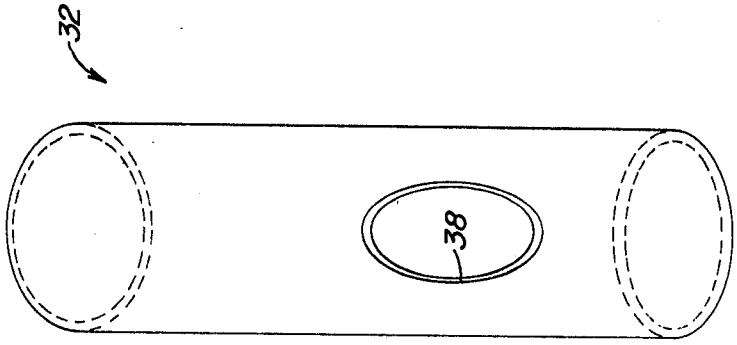
FIG. 2 is a view of the improved exhaust port liner of FIG. 1 along line 2—2.

Formed in the outer curved surface of the arcuately-shaped section 34 is an opening 38 which is best seen in FIG. 2. The opening 38 is aligned with the passageway 16 when the liner 32 is positioned in the exhaust passage 12 and is resting on the valve seat 30.

To assemble the liner 32 into the cylinder head 10, the arcuately-shaped section 34 is inserted into the second end 20 of the exhaust passage 12. The shoulder 28 of the exhaust passage, which has an inner diameter which is slightly larger than the outer diameter of the liner 32, physically prevents the straight section 36 of the liner 32 from being inserted first. This is because after the straight section 36 has passed the shoulder 28 it will abut the inner surface of the exhaust passage 12 and will be prevented from being tilted by the shoulder 28, thereby stopping its progress into the exhaust passage 12.

Returning to the proper method of inserting the liner 32, it will be seen that as the liner 32, approaches the first end 18 the tapered neck 24 will guide the arcuately-shaped section 34 against the top surface of the valve seat 30. Once the liner 32 strikes the valve seat 30, it will be prevented from being inserted any farther. In this position, the opening 38 of the liner 32 will be aligned with the passageway 16 of the cylinder head 10. It cannot be misaligned because the curvature of the liner 32 prevents it from being rotated within the curved exhaust passage 12. With the passageway 16 and the opening 38 aligned, a valve guide 40, having an aperture 42, is pressed into the passageway 16 such that its lower end 44 completely passes through the opening 38. The valve guide 40 assists in positioning the liner 32 in the exhaust passage 12. Positioned through the aperture 42 is a valve stem 46 having a valve 48 secured to one end thereof. The valve 48 and valve stem 46 reciprocate within the aperture 42 of the valve guide 40 so as to open and close against the valve seat 30. The cam mechanism and timing procedure for actuating the valve 48 are well known to those skilled in the engine arts and therefore need not be discussed. For the purpose of this invention, all that is relevant is the fact that when the valve 48 is opened (positioned away from the valve seat 30) exhaust gas from the combustion chamber of the engine, having a temperature of about 600–700 degrees Celsius, flows through the liner 32 to the exhaust manifold 22.

With one end of the liner 32 properly resting on the valve seat 30, a portion of the straight section 36 will extend beyond the second end 20 of the exhaust passage 12. This outward extension of the liner 32 enables the straight section 36 to be aligned within a connecting passage 50 formed within the exhaust manifold 22. This feature permits a support member 52, to be placed between the cylinder head 10 and the exhaust manifold 22. As the manifold is attached by bolts 54 to the cylinder head 10, the support member 52 ensures than an essentially uniform air gap or layer 55 is created between the outer periphery of the liner 32 and the inner diameter of the exhaust passage 12. Preferably, the support member 52 consists of a stainless steel plate 56 sandwiched between two heat resistant elements 58 and 60. When supported as shown in FIG. 1, the air layer 55 provides an insulating medium that decreases the rate of heat loss from the passing exhaust gas (indicated by arrows) which is exiting the engine. By retaining most of the heat in the exiting exhaust gas, one is capable of increasing the effectiveness of an engine's emission control system which is located downstream of the liner 32. This is because the emission control system, which may utilize a catalytic converter or a thermal reactor, is better able to convert the unburned hydrocarbons and the carbon monoxide to carbon dioxide and water when the exhaust gases are at elevated temperatures. This is especially true for a thermal reactor wherein, in the absence of a catalyst, heat alone is used for the conversion. The retention of thermal energy in the exhaust gas is also beneficial in driving a turbocharger on turbocharged engines. The hotter the exhaust gas, the more efficient the turbocharger because more energy is available to turn the turbine rotor which is connected to the compressor wheel. As the compressor wheel is rotated faster, an increase in the incoming air pressure is realized which permits the engine to operate more efficiently.

Referring again to FIG. 1, it can be seen that the smooth, curved stainless steel liner 32 will optimize the flow and expansion of the passing exhaust gases. By minimizing the metal to metal contact between the liner 32 and the cast cylinder head 10 and by utilizing the insulation factor obtained by the presence of an air layer 55, most of the thermal energy in the exhaust gas will be maintained. The heat that does pass through the air layer 55 will be transferred by the cylinder head 10 to a coolant, such as water, which is circulated through the cooling passage 14. The coolant is necessary to ensure that the overall temperature of the engine does not exceed a value wherein irrepairable damage can occur to the engine components.

Although the invention has been written specifically refering to an exhaust port liner, it should be noted that such a liner can also be used in the inlet passage of an engine.

While the invention has been described in conjunction with a specific embodiment, it is to be understood that many alternatives, modifications, and variations will be apparent to those skilled in the art in light of the aforegoing description. Accordingly, this invention is intended to embrace all such alternatives, modifications, and variations which fall within the spirit and scope of the appended claims.

I claim:

1. An improved port liner which is designed to be inserted into an exhaust passage formed in a cylinder head of an engine, said exhaust passage extending from a combustion chamber to an exhaust manifold, a valve seat located at an end of said exhaust passage adjacent to said combustion chamber which is contactable by a movable valve having a valve stem, said valve stem guided by a valve guide mounted in a passageway formed in said cylinder head which intersects said exhaust passage, wherein the improvement comprises:

(a) a liner having an arcuately-shaped section and a straight section, both sections having an outside diameter which is smaller than the inner diameter of said exhaust passage, and an opening formed in an outer surface of said arcuately-shaped section for permitting the passage of said valve guide therethrough, said liner, when inserted into said exhaust passage, forming a relatively uniform air insulating layer between the outer surface of said liner and the inner surface of said exhaust passage for facilitating the flow of hot exhaust gases from said combustion chamber to said exhaust manifold with a minimum loss of thermal energy; and (b) an annular shoulder formed on the inner surface of said exhaust passage approximate said exhaust manifold, said shoulder having an inner diameter which is larger than the outer diameter of said inner and which serves to prevent said liner from being wrongly inserted into said exhaust passage.

2. The improved port liner of claim 1 wherein said arcuately-shaped section has a curvature of approximately 90 degrees.

3. A method of assembling a liner in an exhaust passage formed in a cylinder head of an engine, said exhaust passage having a tapered first end surrounded by a valve seat which is closeable by a stemmed exhaust valve reciprocatively guided by a valve guide mountable in a passageway of said cylinder head and a second end opened to a connecting passage formed in an adjoining manifold which is attachable to said cylinder head, said exhaust passage further having an inwardly projecting peripheral shoulder formed on the interior surface thereof approximate said second end, said liner having an arcuately-shaped section with an opening in the outer curved surface thereof and a straight section, both sections having an outside diameter which is smaller than the inside diameter of said exhaust passage, which method comprises:

(a) forming an annular shoulder on the inner surface of said exhaust passage approximate said second end thereof, said shoulder having an inner diameter which is larger than the outer diameter of said liner;

(b) inserting said arcuately-shaped section of said liner through said annular shoulder and into said exhaust passage until contact is made with said valve seat such that a portion of said straight section extends outward beyond said second end of said exhaust passage;

(c) pressing said valve guide into said cylinder head passageway so that an end of said valve guide passes through said opening in said liner and extends into said exhaust passage;

(d) positioning said stemmed exhaust valve in said cylinder head so that said stem passes through both said liner opening and said valve guide; and (e) attaching said manifold to said cylinder head so that said straight section of said liner extends into said connecting passage of said manifold and is retained therein such that a single continuous air chamber is formed between the outer periphery of said liner and the interior surface of said exhaust passage which acts as a heat insulating layer to facilitate the flow of hot exhaust gases out of said engine.

4. The method of claim 3 wherein heat insulated support members are positioned between said cylinder head and said manifold for aligning said liner within said exhaust passage so that a uniform air chamber is formed along the entire length of said arcuately-shaped section of said liner between the outer periphery of said liner and the interior surface of said exhaust passage, said heat insulated support members including a metallic plate sandwiched between a pair of heat resistant elements, all of which contact the outer periphery of said liner.

5. In an engine cylinder head having an exhaust passage formed therein and extending from a first end adapted to communicate with a cylinder in an engine block to a second end adapted to communicate with an exhaust manifold, a valve seat located in the first end of said exhaust passage, a valve passageway formed in said head and intersecting said exhaust passage, and a liner positioned in said exhaust passage providing an air gap between its outer surface and the wall of said exhaust passage, said liner being provided with a valve opening in alignment with said valve passageway, the improvement comprising:

(a) said exhaust passage being of arcuate shape from the first to the second end with a substantially constant radius of curvature and having a narrow annular shoulder formed on the inner peripheral surface thereof approximate said second end, said shoulder having an inner diameter which is larger than the outer diameter of said liner for preventing said liner from being wrongly inserted into said exhaust passage;

(b) said liner having a section extending from a first end adjacent said valve seat through a major portion of said exhaust passage of arcuate shape with a radius of curvature substantially equal to the radius of curvature of the exhaust passage; and (c) said liner having a straight section integral with and extending from the section of arcuate shape past the second end of the exhaust passage to a second end, the straight section being of sufficient length that interference between the liner and walls of the exhaust passage will prevent insertion of the liner into the exhaust passage from the second end thereof with the straight section first.

6. The cylinder head as set forth in claim 5 wherein said valve seat contains a surface which is engaged by the first end of said liner when said liner is fully inserted into said exhaust passage such that the radius of curvature of both said exhaust passage and said liner cooperate with the engagement between said surface and said first end of said liner to insure proper alignment between said valve passageway and said valve opening in said liner so that a valve stem guide and a valve stem can be easily inserted therethrough.

7. The improved port liner of claim 1 wherein said annular shoulder is spaced apart from the exterior surface of said liner when said liner is fully inserted into said exhaust passage.

8. The improvement of claim 5 wherein said shoulder is spaced apart from the exterior surface of said liner when said liner is fully inserted into said exhaust passage.

* * * * *

UNITED STATES PATENT AND TRADEMARK OFFICE

CERTIFICATE OF CORRECTION

PATENT NO. : 4,430,856

DATED : 14 February 1984

INVENTOR(S) : David W. Niedert

It is certified that error appears in the above-identified patent and that said Letters Patent is hereby corrected as shown below:

Column 4, line 61, delete "inner" and insert -- liner --.

Signed and Sealed this

*First* Day of *January 1985*

[SEAL]

*Attest:*

*Attesting Officer*

GERALD J. MOSSINGHOFF

*Commissioner of Patents and Trademarks*